US006411070B1

(12) United States Patent
Ito

(10) Patent No.: US 6,411,070 B1
(45) Date of Patent: Jun. 25, 2002

(54) POWER CONTROL APPARATUS FOR TIMELY POWERING DOWN INDIVIDUAL CIRCUIT BLOCK

(75) Inventor: Masahiro Ito, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 09/696,190

(22) Filed: Oct. 26, 2000

(30) Foreign Application Priority Data

Oct. 29, 1999 (JP) ..... 11-310345

(51) Int. Cl.[7] ..... G05F 1/56
(52) U.S. Cl. ..... 323/284
(58) Field of Search ..... 323/282, 283, 323/284, 268

(56) References Cited

U.S. PATENT DOCUMENTS 5,705,920 A * 1/1998 Watanabe et al. ..... 323/285
5,864,225 A * 1/1999 Bryson ..... 323/268
6,272,029 B1 * 8/2001 Hirose ..... 363/59

* cited by examiner

*Primary Examiner*—Adolf Deneke Berhane

(57) ABSTRACT

The present invention relates to a power control apparatus. A feature of the power control apparatus of the present invention is that it discriminates whether an input signal in a circuit block to be controlled is active or inactive, and when it is determined that the input signal is inactive, it outputs a power-down signal to power down the circuit block.

8 Claims, 6 Drawing Sheets

POWER CONTROL APPARATUS FOR TIMELY POWERING DOWN INDIVIDUAL CIRCUIT BLOCK

BACKGROUND OF THE INVENTION

1. Field of the Invention

The present invention relates to a power control apparatus for controlling power-on or power-off of each circuit block in a system containing a plurality of circuit blocks.

This application is based on a Japanese Patent Application No. Hei 11-310345 filed in Japan, the content of which is incorporated herein by reference.

2. Description of the Related Art

Conventionally, to control power-on or power-off for each circuit block in a system containing a plurality of circuit blocks, some apparatus has been known to require the user or the sequencer to decide to turn on or off each of the power blocks, and based on such decisions, a controller, such as CPU that controls the operation of the overall system, is used to control the power supplied to each circuit block.

In such a system, the user or the sequencer initially decides whether to use each circuit block having a specific function such that those circuit blocks that will not be used are turned off (power-down) individually and the circuit block that is decided to be used by the user or the sequencer are turned on. To operate a circuit block, it is essential that the environment of the circuit block, such as the state of the clock signal input in the circuit block, satisfies the conditions required to operate this circuit block.

The conditions for the environment of the circuit block to operate are not satisfied, for example, when the clock signal that has been input in the circuit. block to operate the circuit block is inactive, information such as error status is sent back from the circuit block to the user or the sequencer, so that the user or the sequencer must again send a command to stop the operation of the circuit block. As such, the circuit block may be powered down in accordance with the command. Here, an inactive clock signal means that the voltage level of the clock signal is fixed at either the H-level or L-level, for example.

However, according to such a method of processing, when the environment of the circuit block does not satisfy the conditions to operate the circuit block, for example, when the clock signal input in the circuit block is inactive, (for example, the clock signal is fixed at either the H-level or L-level), it is not possible to immediately power down the circuit block in a real-time manner.

That is, when powering down, it is inevitable for the user or the sequencer to suffer the inconvenience of the prior art proceeding. For this reason, when the environment for operating the circuit block is not satisfied, some time (delay interval) is required until the circuit block is powered down. As a result, the circuit block maintained in the operational state (not powered down) during this delay interval causes wasteful consumption of electrical power.

Conversely, if an attempt is made to power down the circuit block in real-time using the structure of the conventional technology, it is necessary to frequently check the environmental conditions, such as clock signal, by using the controller, such as CPU.

If a quick power-down cannot be carried out when the clock signal input in the circuit block is inactive as in the above-mentioned conventional technology (ex., if this circuit block is a dynamic circuit in an LSI semiconductor) while the power is being supplied to the dynamic circuit, the clock signal to operate the dynamic circuit is stopped. In such a case, the electrical charge on the condenser in the dynamic circuit is discharged due to leaking, so that, an intermediate-potential point is created in the CMOS circuit in the dynamic circuit. As such, the intermediate potential causes a punch-through current in the CMOS circuit which results not only in consuming a large quantity of current but in creating a dangerous situation that the LSI circuit may be destroyed by the current.

SUMMARY OF THE INVENTION

The present invention is provided to resolve the problems presented above so that a power control apparatus powers down a circuit block immediately in a real-time manner, when the environment of the circuit block does not satisfy the conditions to enable the circuit block to operate, for example, when the clock signal input in a circuit block to operate the circuit block is inactive (for example, clock signal level is fixed at either the H-level or L-level).

According to the present invention, an object is achieved in a power control apparatus having a feature to discriminate whether an input signal in a circuit block to be controlled is active or inactive, and when the input signal is determined to be inactive, to output a power-down signal to power down the circuit block.

According to the above feature, when the power control apparatus determines that the input signal in the circuit block is inactive, i.e., when the conditions to operate the circuit block are not satisfied, a power-down signal is output immediately such that the circuit block can be powered down quickly to keep the power consumption of the circuit block to a minimum.

On the other hand, when the input signal to the circuit block is determined to be active, i.e., when the conditions for operating the circuit block are ready, the power-down signal can be released immediately so that the operation of the circuit block can be started immediately without time lag.

According to the present invention, it is possible to quickly and automatically discriminate whether the input signal to the circuit block is active or inactive, and, when the input signal is determined to be inactive, the circuit block can be powered down quickly. Therefore, the power consumed by the circuit block can be kept to a minimum. Furthermore, to perform this control, there is no need for the user or sequencer to perform laborious processing.

For example, if the present invention is used for the clock signal input section of an LSI circuit comprised by a dynamic circuit, even if the supply of operational clock to the dynamic circuit is suddenly stopped, it is possible to automatically power down the dynamic circuit. As such, there is no concern for problems such as punch-through current of the dynamic circuit. Accordingly, the dynamic circuit can be handled in the same manner as a static circuit, which facilitates the handling of the dynamic circuit.

Also, according to the present invention, the object is achieved in a power control apparatus having a feature that an input signal to the circuit block is a signal (for example, a clock signal) that alternates between a first voltage level and a second voltage level at a frequency that is less than a specific cycle.

According to the above structure, when the power control apparatus determines that the input signal in a circuit block is inactive, a power-down signal is output immediately so that the circuit block can be powered down quickly.

Also, when the circuit block is a dynamic circuit inside an LSI circuit, for example, supplying or stopping the clock signal can be handled in the same manner as for a static circuit. Therefore, there is no concern for problems such as punch-through current within the dynamic circuit. That is, according to the present invention, when the clock signal to the dynamic circuit is stopped, clock stopping is automatically detected and the dynamic circuit is powered down so that the punch-through problem does not arise.

According to one aspect of the present invention, a power control apparatus comprises a switch that turns on or off according to a voltage level of an input signal to the circuit block, a condenser whose charging current or discharging current is controlled by the switch, and a comparator to compare a voltage between both ends of the condenser with a specific reference voltage, and to output a power-down signal to power down the circuit block in accordance with a result of comparison.

According to the above structure, when an input signal input in a circuit block, becomes inactive, and the voltage level of the input signal is fixed at either the H-level or L-level, the switch is fixed at either on or off. Accordingly, the condenser is fixed in a state of either being charged or discharged. Then, the comparator comparing the voltage between both ends of the condenser with the reference voltage, after a specific time interval, detects an inversion of the magnitude relationship between the two voltages, and outputs the power-down signal. Therefore, the circuit block to be controlled can be powered down quickly.

According to another aspect of the present invention, a power control apparatus comprises a first discrimination section and a second discrimination section. The first discrimination section is comprised by a first switch that turns on or off according to a voltage level of an input signal to the circuit block, and turns off when the input signal is at a first voltage level; a first condenser whose charging current or discharging current is controlled by the first switch; a first comparator to compare a voltage between both ends of the first condenser with a specific reference voltage, and to output a first power-down signal in accordance with a result of comparison. The second discrimination section is comprised by a second switch that turns on or off according to a voltage level of an input signal to the circuit block, and turns off when the input signal is at a second voltage level; a second condenser whose charging current or discharging current is controlled by the second switch; a second comparator to compare a voltage between both ends of the second condenser with a specific reference voltage, and to output a second power-down signal in accordance with a result of comparison. The apparatus further comprises an outputting device to output a power-down signal to power down the circuit block when the first power-down signal or the second power-down signal is output.

According to the above structure, when the input signal to a circuit block becomes inactive, if the voltage level of the input signal is fixed at the first voltage level (for example, H-level), the first discrimination section detects that the input signal is inactive, and it outputs the first power-down signal. When the input signal to the circuit block becomes inactive, if the voltage level of the input signal is fixed at the second voltage level (for example, L-level), the second discrimination section detects that the input signal is inactive, and it outputs the second power-down signal. If either the first power-down signal or the second power-down signal is output, the output means outputs a power-down signal that is an ultimately determined result, to the circuit block to be controlled. Therefore, when the input signal to the circuit block is inactive, regardless of whether the voltage level of the input signal is fixed at the first voltage level (for example, H-level) or at the second voltage level (for example, L-level), a power-down signal can be output.

That is, by providing the first discrimination section and the second discrimination section, and examining a case of the input signal being fixed at the first voltage level as well as a case of the input signal being fixed at the second voltage level, the circuit block to be controlled can be powered down when the input signal is fixed at either of the two voltage levels.

According to another aspect of the present invention the power control apparatus further comprises a synthesizer for synthesizing a power-down signal according to an external power-down signal input externally to the power control apparatus and an internal power-down signal to be output when it is determined that an input signal to the circuit block is inactive and outputting a synthesized power-down signal to the circuit block; and a self-powering-down device for powering-down the power control apparatus itself when the external power-down signal is input.

According to the above structure, the synthesizer synthesizes an external power-down signal and the internal power-down signal, and a synthesized power-down signal is output to the circuit block. In the case of an external power-down signal forwarded from a device external to the power control apparatus of the present invention, or in the case of the input signal to the circuit block determined to be inactive within the power control apparatus, it is possible to output a synthesized power-down signal to the circuit block.

For example, if either the user or the sequencer outputs an external power-down signal from a controller for controlling the overall system, such as CPU, this external power-down signal is input in the power control apparatus of the present invention, and by inputting the synthesized power-down signal output from the power control apparatus in the circuit block to be controlled, this circuit block is powered down.

Also, when the user of the sequencer releases the external power-down signal, which is detected by the power control apparatus of the present invention, and the power control apparatus immediately stops outputting the synthesized power-down signal to the circuit block. The circuit block can resume its operation immediately. Further, immediately afterwards, the power control apparatus of the present invention determines whether the input signal is active or inactive, and if the input signal is active, the operation of the circuit block is continued, and if the input signal is inactive, the circuit block is powered down.

Also, when an external power-down signal is input, the self-power-down device powers down the power control apparatus itself. Therefore, when an external power-down signal is sent from a device external to the power control apparatus of the present invention, the power consumption by the power control apparatus itself can be kept to a minimum.

That is, when the system is constructed such that the circuit block can also be powered down by an external power-down signal, by powering down the self-power-down system itself according to the external power-down signal, unnecessary power consumption can be saved so that power consumption for the overall system can be suppressed even further.

Also, according to the present invention, when the external power-down signal is received, the self-powering-down device first prohibits outputting of the power-down signal to the synthesizer and then power down the power control apparatus itself.

According to the above structure, when a power-down signal is issued from the central power-down managing apparatus (CPU and the like) for controlling the overall system, that is, an external power-down signal has been issued, and this power-down signal is input in the power control apparatus of the present invention, the self-powering-down device prohibits sending a power-down signal to the power control apparatus, which is synthesized after determining whether the input signal to the circuit block to be controlled is active or inactive.

In other words, when an external power-down signal is input in the power control apparatus, the self-powering-down device forces a power-down signal, intended originally to be synthesized by the power control apparatus by determining whether the input signal to a circuit block is active or inactive, to be active (for example, a voltage level to indicate the active level, in the embodiment, H-level is used to indicate active), regardless of whether the input signal to the circuit block is active or inactive.

Then, after performing the above operation, the self-powering-down device powers down the power control apparatus itself.

Therefore, when the external power-down signal is released next and the power-down of the circuit block to be controlled is released and the power-down state of the power control apparatus itself is released, the power control apparatus is booted up, in the state that shows active power-down signal, the synthesized power-down signal output by the synthesizer is also released immediately. Therefore, when the external power-down signal is released, the power-down of the circuit block is quickly released and this circuit block can be booted up.

DESCRIPTION OF THE PREFERRED EMBODIMENTS

The following embodiments do not limit the interpretation of the claims of the present invention, and the combination of all the features explained in the embodiments may not always be necessary to achieve the objective.

Figure 1:
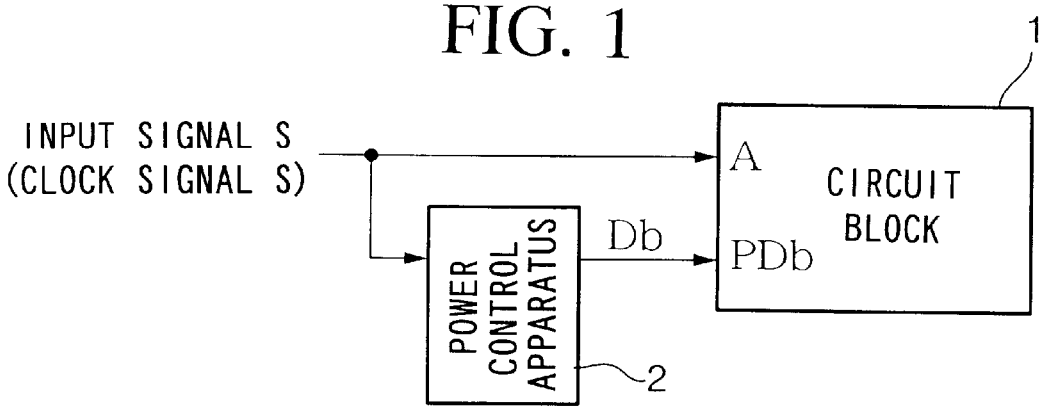
FIG. 1 is a block diagram of a first embodiment of the present invention.

The first embodiment of the present invention is explained with reference to FIG. 1. An input signal S is input to an input terminal A of a circuit block 1 within the system. A specific example of the input signals S is the clock signal S to operate the circuit block 1. The input signal S is input in the power control apparatus 2 according to the present invention, and the output of the power control apparatus 2, i.e., a power-down signal Db is input in the power-down terminal PDb of the circuit block 1. The circuit block 1 is powered down when the powder-down signal Db is low-active (L-active), i.e., when power-down signal Db=L.

The operation of the embodiment is outlined below. The power control apparatus according to the present invention splits and inputs the input signal S originally for the circuit block 1, and discriminates whether the input signal S is active or inactive. And, if the input signal S is inactive, the output of the power control apparatus 2, which is the power-down signal Db, is immediately made active, i.e., the power-down signal is made as Db=L. The power-down signal Db is input in the power-down terminal PDb of the circuit block 1. When it is input, the circuit block 1 is immediately powered down.

According to the above structure, the power control apparatus 2 is able to perform the operation starting from detecting inactivity of the input signal S to outputting the power-down signal Db more quickly than the prior art. That is, in the prior art, when the input signal S in the circuit block 1 is inactive, information such as error status is returned to the user or the sequencer, then the user or the sequencer must newly send a command to stop the operation of the circuit block 1, and then the circuit block 1 is powered down according to the command. The time interval between the events of detecting the input signal to be inactive and powering down of the circuit block 1 has been long. However, according to the present invention, when the input signal S becomes inactive, this is immediately detected by the power control apparatus 2, and further, the power-down signal Db is sent directly from the power control apparatus 2 to the circuit block 1, so that the time interval is shortened between the events of detecting the input signal to be inactive and powering down of the circuit block 1.

Next, the internal structure of the power control apparatus 2 is explained with reference to the circuit diagram in FIG. 2. Here, in FIG. 2, the input signal S is assumed to be the clock signal S. Also, the power control apparatus 2 shown in FIG. 2 corresponds to the structure in which the clock signal S is fixed at the high (H) level when it is inactive.

The clock signal S is input in the gate terminal PG of a Pch-transistor (P channel transistor) 3, and the source terminal PS of the Pch-transistor 3 is connected to the power source potential Vcc. The drain terminal of the Pch-transistor 3 is connected to the one terminal 4*a* of the condenser 4. The other terminal 4*b* of the condenser 4 is connected to the ground potential Gnd.

The one terminal 4*a* of the condenser 4 is connected to the non-inverting input terminal 5*a* of a comparator 5. The non-inverting input terminal 5*b* of the comparator 5 is connected to a specific threshold potential Vt1. The power-down signal Db is output from the output terminal 5*c* of the comparator 5.

The operation of the power control apparatus 2 is explained with reference to the timing chart in FIG. 3. As shown in the time interval between times t1 and t3, if the clock signal S is active, this clock signal S alternates between the states of H-level and the L-level. Because the clock signal S is input in the gate terminal PG of the Pch-transistor 3, the Pch-transistor 3 is turned on/off accordingly.

When the clock signal S becomes L-level and the Pch-transistor 3 is turned on, the current flows from the power source potential Vcc to the condenser 4 by way of the Pch-transistor 3 and the condenser 4 is charged such that the potential of the terminal 4*a* of the condenser 4 increases.

When the clock signal becomes H-level and the Pch-transistor 3 is turned off, the charging of the condenser 4 is stopped. Further, due to leaking of electrical charge of the condenser 4, the condenser 4 is gradually discharged and the potential of the terminal 4*a* of the condenser 4 is gradually decreased. Because such discharging is caused only by leaking, the charging amount is higher such that upon passage of time while the clock signal S is active, the potential at the terminal 4*a* of the condenser 4 increases. Then, as shown by time t2 in FIG. 3, the potential of the terminal 4*a* of the condenser 4 exceeds the threshold potential Vt1 of the comparator 5.

When the potential of the terminal 4*a* of the condenser 4 exceeds the threshold potential Vt1, the output of the comparator 5, i.e., the voltage level of the power-down signal Db, changes from L-level to the H-level. When the power-down signal Db becomes H-level, the power-down of the circuit block 1 controlled by this power-down signal Db is cancelled, and the circuit block 1 becomes operative.

Figure 3:
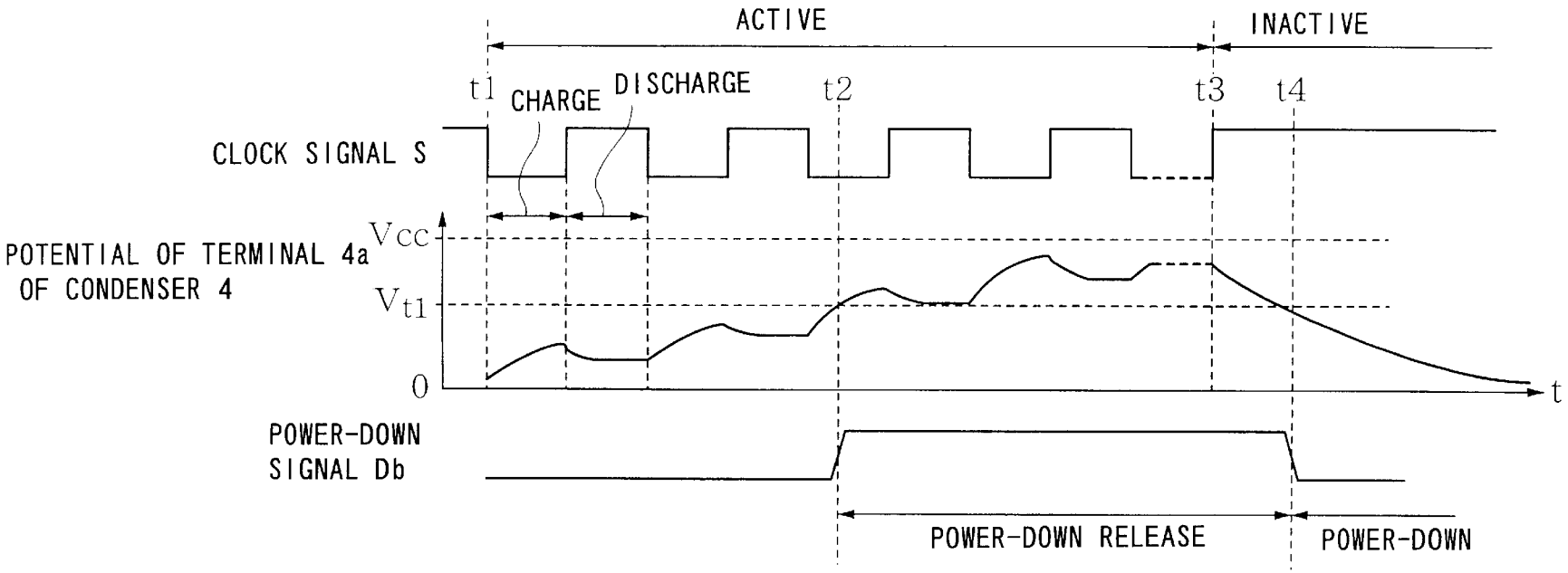
FIG. 3 is a timing chart to show the operation of the circuit shown in FIG. 2.

As shown by the timechart subsequent to time 0 in FIG. 3, when the clock signal S becomes inactive, because this clock signal S becomes fixed at the H-level, the Pch-transistor 3 is turned off and the condenser 4 is not charged. Then, because of the discharging due to leaking, the potential of the terminal 4*a* of the condenser 4 gradually decreases. As indicated by time t4 in FIG. 3, the potential of the terminal 4*a* of the condenser 4 becomes less than the threshold potential Vt1. Then, the output of the comparator 5, i.e., the power-down signal Db changes from H-level to L-level, and accordingly, the circuit block 1 is put into the power-down state.

That is, when the clock signal S becomes inactive, and the voltage level of this clock signal S becomes fixed at the H-level, this is immediately detected by the power control apparatus 2. Furthermore, the power-down signal Db is sent directly to the circuit block 1 such that the circuit block 1 can be powered down immediately.

Figure 4:
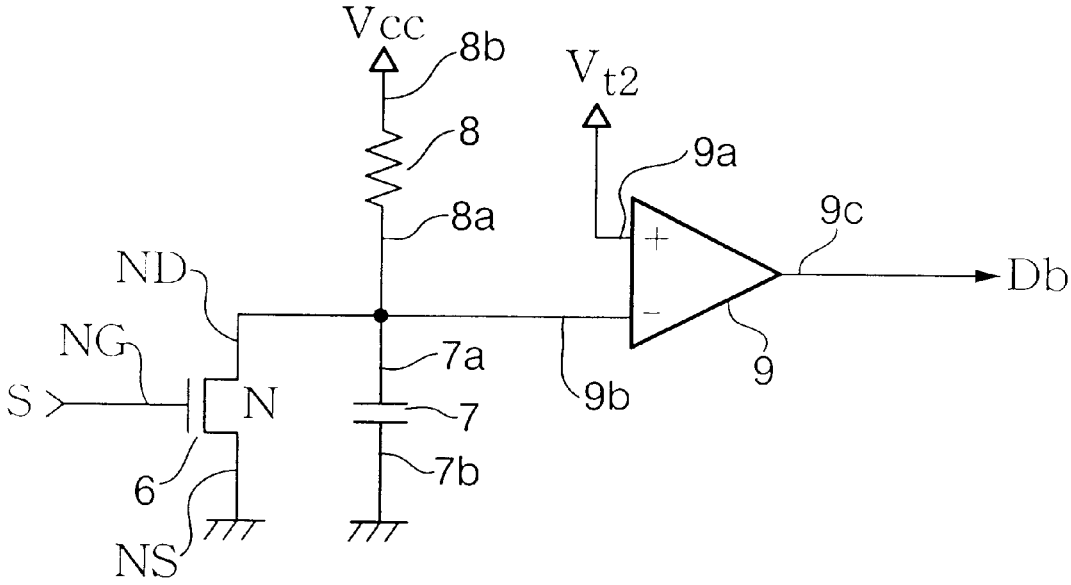
FIG. 4 is an example of another configuration of the internal structure of the power control apparatus shown in FIG. 1.

Next, another configuration of the power control apparatus 2 is explained with reference to the circuit diagram in FIG. 4. In FIG. 4, the input signal S is also assumed to be the clock signal S. The power control apparatus 2 shown in FIG. 4 corresponds to the structure in which the clock signal S is fixed at the L-level when it is inactive.

The clock signal S is input in the gate terminal NG of the Nch-transistor (N channel transistor) 6, and the source terminal NS of the Nch-transistor 6 is connected to the ground potential Grid, and the drain terminal ND of the Nch-transistor 6 is connected to the one terminal 7*a* of the condenser 7. The other terminal 7*b* of the condenser 7 is connected to the ground potential Grid. Further, the drain terminal ND of the Nch-transistor 6 is connected to the other terminal 8*a* of the resistor 8, and the other terminal of the resistor 8 is connected to the power source potential Vcc.

The one terminal 7*a* of the condenser 7 is connected to the inverting input terminal 9*b* of the comparator 9. The non-inverting terminal 9*a* of the comparator 9 is connected to a specific threshold potential Vt2. The power-down signal Db is output from the output terminal 9*c* of the comparator 9.

The operation of the power control apparatus 2 is explained with reference to the timing chart in FIG. 5. As shown in the time interval between times t5 and t6, if the clock signal S is active, this clock signal S alternates between the states of H-level and the L-level. Because the clock signal S is input in the gate terminal PG of the Nch-transistor 6, the Nch-transistor 6 is turned on/off accordingly.

When the clock signal S becomes L-level and the Pch-transistor 6 is turned off, the current flows from the power source potential Vcc to the condenser 7 by way of the resistor 8 and the condenser 7 is charged, and the potential of the terminal 7*a* of the condenser 7 increases.

When the clock signal S becomes H-level and the Nch-transistor 6 is turned on, both terminals of the condenser 7 are shorted, and the charge accumulated in the condenser 7 is discharged.

Therefore, when the clock signal S alternates between the H- and L-levels, the charging and discharging of the condenser 7 are performed alternatingly, and the potential of the terminal 7*a* of the condenser 7 will not be able to exceed the specific potential, i.e., the threshold potential Vt2 of the comparator 9.

If the potential of the terminal 7*a* of the condenser 7 does not exceed the threshold potential Vt2, the output of the comparator-9, i.e., the voltage level of the power-down signal Db becomes H-level. When the power-down signal Db is at the H-level, power-down of the circuit block 1 controlled by this power-down signal Db is released, and the circuit block 1 becomes operative.

Figure 5:
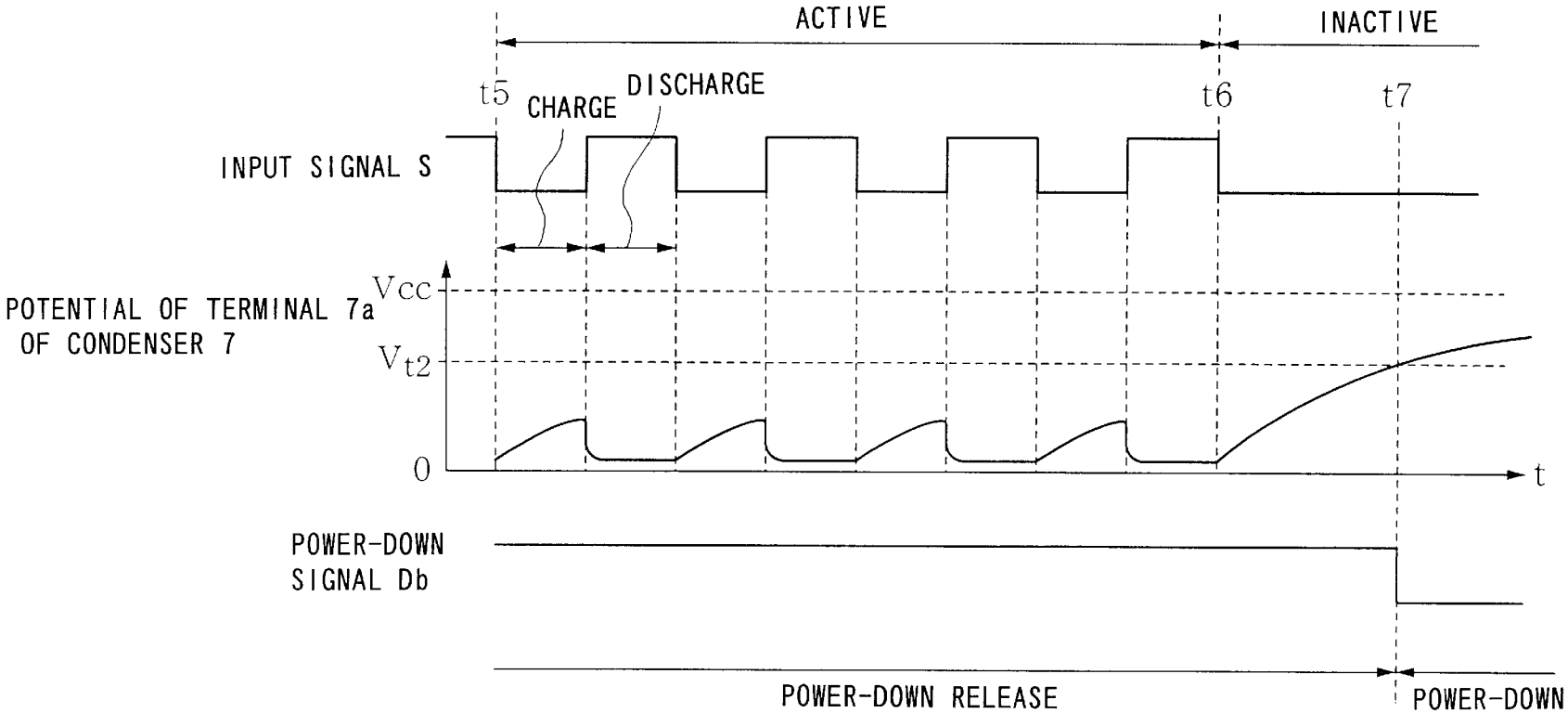
FIG. 5 is a timing chart to show the operation of the circuit shown in FIG. 4.

As shown by the timechart subsequent to time t6 in FIG. 5, when the clock signal S becomes inactive, this clock signal S is fixed at the L-level, so that the Nch-transistor 6 is fixed at power-off and the condenser 4 is subjected only to charging, but not discharging. Then, because of this charging, the potential of the terminal 7*a* of the condenser 7 exhibits an increasing state only. And, as indicated by time t7 in FIG. 5, the potential of the terminal 7*a* of the condenser 7 exceeds the threshold potential Vt2. Then, the output of the comparator 9, i.e., the power-down signal Db changes from H-level to L-level, and accordingly, the circuit block 1 is made into the power-down state.

That is, when the clock signal S becomes inactive, and the voltage level of the clock signal S becomes fixed at the L-level, this is immediately detected by the power control apparatus 2. Furthermore, because the power-down signal Db is sent directly from the power control apparatus 2 to the circuit block 1, the circuit block 1 can be powered down immediately.

Figure 2:
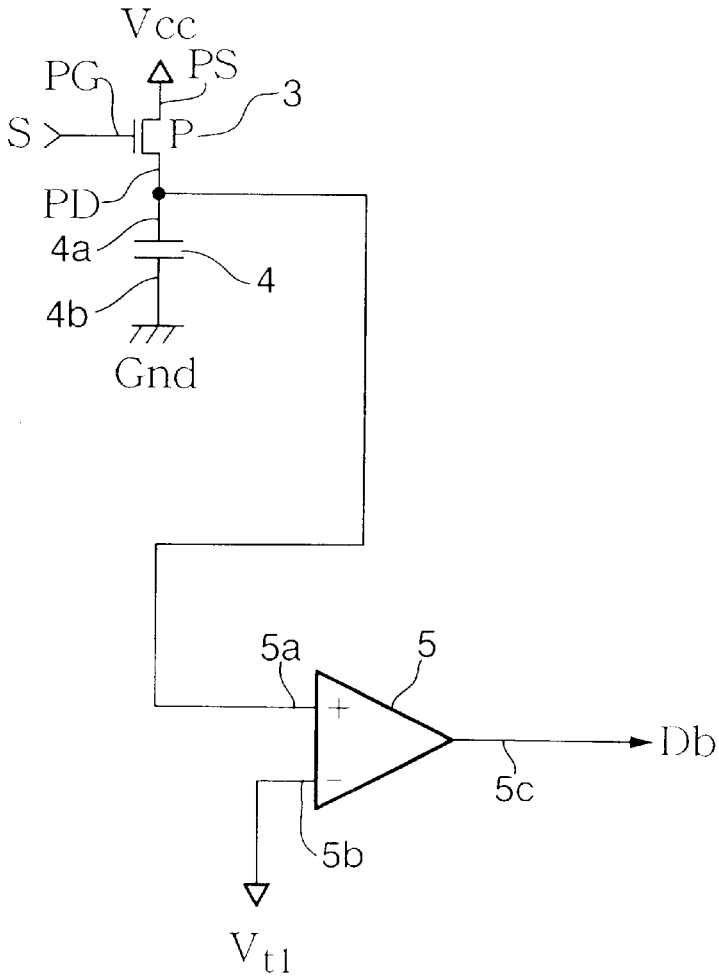
FIG. 2 is an internal circuit diagram of the power control apparatus of the first embodiment.

If the power control apparatus 2 is provided with the circuit shown in FIG. 2 as well as the circuit shown in FIG. 4, when the clock signal S becomes inactive and when the voltage level of the clock signal S is fixed at the H-level, it adapts to a case of the voltage level of the clock signal S being fixed at the H-level as well as a case of being fixed at the U-level.

Figure 6:
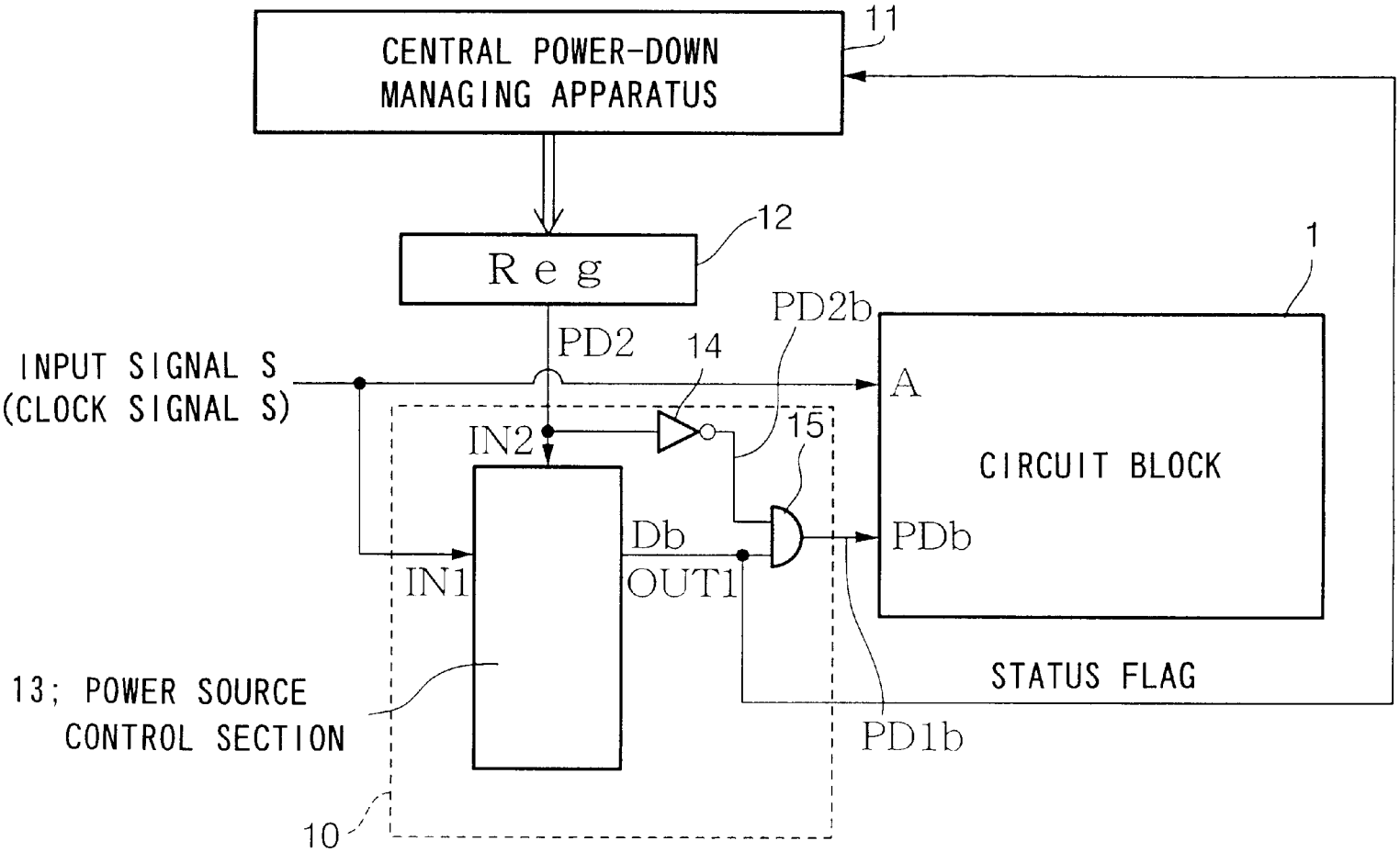
FIG. 6 is a block diagram of a second embodiment of the present invention.

Next, the second embodiment of the present invention is explained with reference to the block diagram shown in FIG. 6. The power control apparatus 10 in the second embodiment houses a power source control section 13, an inverter 14 and an AND-circuit 15 internally.

The second embodiment presents an example of a system that contains a central power-down managing apparatus 11 for centrally controlling power-down events for each circuit block within the system so that the commands from the central power-down managing apparatus 11 can also be used to power down the circuit block 1.

The central power-down managing apparatus 11 is comprised specifically by CPU or the like. The output from the central power-down managing apparatus 11 is input in the register 12. That is, the register 12 stores powder-down signal PD2 sent from the central power-down managing apparatus 11 and outputs the stored power-down signal PD2 to the power control apparatus 10. The power-down signal PD2 is high(H)-active. That is, when the power-down signal PD 2=11, the circuit block 1 is powered down.

The power-down signal PD2 input in the power control apparatus 10 is input in the input terminal IN2 of the power source control section 13 housed inside the power control apparatus 10. At the same time, the power-down signal PD2 is also input in the inverter 14, and the output from the inverter 14, i.e., the inverted power-down signal PD2b, is input in one of the two input terminals of the AND-circuit 15. To the other input terminal of the AND-circuit 15, a power-down signal Db output from the output terminal OUT1 of the power source control section 13 is input. This power-down signal Db is also output externally to the power control apparatus 10, and is input to the central power-down managing apparatus 11 as a status flag.

The output from the AND-circuit 15, i.e., the power-down circuit PD1b, is output from the power control apparatus 10 externally, and this output is input to the power-down terminal PDb of the circuit block 1 which is the circuit block to be controlled.

As in the first embodiment, the input signal S originally to be input in the input terminal A of the circuit block 1 to be controlled is split and is also input in the power control apparatus 10. The input signal S input in the power control apparatus 10 is input via the input terminal IN1 of the power source control section 13 housed internally in the power control apparatus 10.

Next, the operation of the present embodiment is explained. Each circuit block in the system is structured so that the power to each block can be stopped as a unit, and the power-down control for individual circuit block can be carried out according to commands from the central power-down managing apparatus 11. When the input signal S becomes inactive, the circuit block can be powered down automatically by the power control apparatus 10 of the present invention.

That is, the circuit block 1 is powered down when a power-down command is issued from the central power-down managing apparatus 11 as well as when the power control apparatus 10 determines that the input signal S has become inactive.

Furthermore, as described later, when a power-down command is issued from the central power-down managing apparatus 11, the power control apparatus 10 itself is powered down, and accordingly, the power consumption can be held to a minimum.

For this reason, in the power-down terminal PDb of the circuit block 1 to be controlled, a logical product of an inverted power-down signal PD2b of a power-down signal PD2 originating from the central power-down managing apparatus 11 and inverted in the inverter 14 and the output signal outperform the power source control section 13, i.e., the power-down signal PD1b is input.

When the circuit block 1 is to be powered down by a command from the central power-down managing apparatus 11, the power-down signal PD2 originating from the central power-down managing apparatus 11 is at the H-level. This H-level power-down signal PD2 is input in the input terminal of the inverter 14 as well as in the input terminal IN2 of the power source control section 13, and according to this input, the power source section 13 is also powered down. When the power source control section 13 itself is to be powered down, the output from the output terminal OUT1 of the power source control section 13, i.e., the power-down signal Db, is first put to the H-level, i.e., a voltage level to show the active state, and is then powered down.

The power source control section 13, when the input signal S is inactive, sets its output signal, the power-down signal Db, at the L-level. Therefore, the output of the AND-circuit 15 with an input of power-down signal Db, i.e., the power-down signal PD1*b*, also becomes L-level. Because the power-down signal PD1*b* put to the L-level is input in the power-down terminal PI)b of the circuit block 1, this circuit block 1 is powered down.

Therefore, when the input signal S is inactive, the circuit block 1 is automatically powered down by the power source control section 13.

When the circuit block 1 is to be powered down by a command from the central power-down managing apparatus 11, the power-down signal Db output from the power source control section 13 is made to be H-level, i.e., to show the active state, and the reasons for this are explained below.

As described earlier, because the circuit block 1 is automatically powered down by the power source control section 13, if the input signal S is inactive, the power consumption in the circuit block 1 is reduced.

However, when the user, using the power source control section 13, does not need the automatic detection function whether the input signal S is active or inactive, it is desirable that the power source control section 13 is also powered down so as to save power consumption further. That is, when the circuit block 1 is to be powered down by a command from the central power-down managing apparatus 11, the function of the power source control section 13 becomes unnecessary so that the power source control section 13 is also powered down.

If, in doing so, the power-down signal Db output from the power source control section 13 is set to the L-level, i.e., the level to show the inactive state, when a release command is issued next from the central power-down managing apparatus 11, it can not immediately boot up the circuit block 1.

According to the present invention, the circuit block 1 is powered down by a command from the central power-down managing apparatus 11. Subsequently, when the power-down is to be released by a command from the same central power-down managing apparatus 11, the power source control section 13 is able to boot up the circuit block 1 immediately because the power-down signal Db output from the power source control section 13 is at the H-level, i.e., it is booted up at a voltage level to show the active state so that the circuit block 1 is also immediately booted up.

Then, after the circuit block has been booted up, the power source control section 13 determines whether the input signal S is active or inactive. If it is active, the circuit block 1 continues to operate as is. If it is inactive, it is immediately powered down.

Because the circuit block 1 is directly powered down by the power source control section 13 if the input signal S is inactive, the central power-down managing apparatus 11 does not need to confirm the status flag output from the power source control section 13 as in the prior art, i.e., to confirm a power-down signal Db and to newly issue a power-down signal PD2 as a result of the confirmation.

Figure 7:
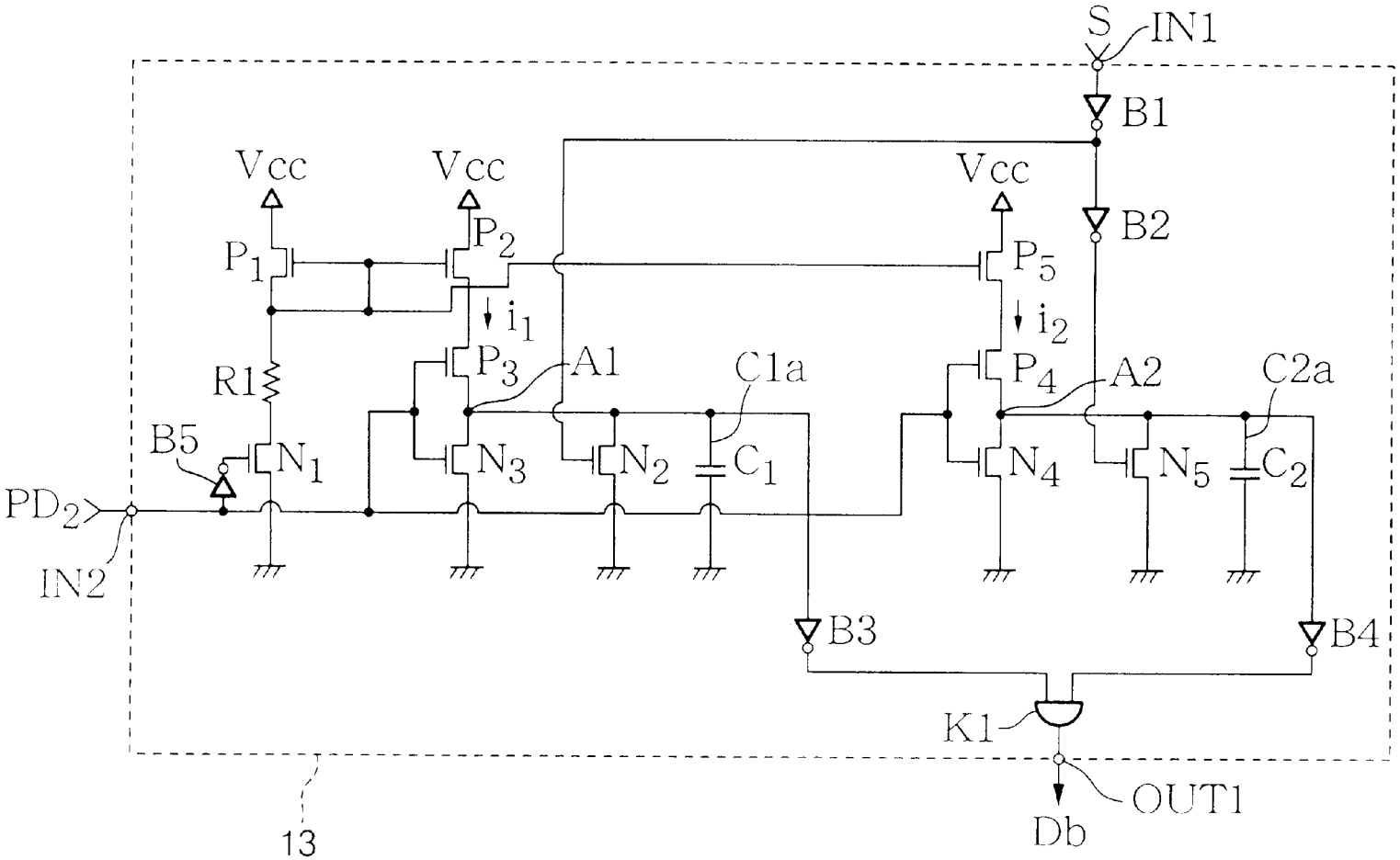
FIG. 7 is a circuit diagram of the internal circuit diagram of the power control apparatus of the second embodiment.

Next, the internal structure of the power source control section 13 is explained with reference to the circuit diagram in FIG. 7. First, the structure of the power source control section 13 is explained. In the diagram, P1-P5 relate to Pch-transistors, N1-N5 to Nch-transistors, C1, C2 to condensers, R1 to a resistor, 131–135 to inverters, and K1 to an AND-circuit.

The power-down signal PD2 sent from the central power-down managing apparatus 11 by way of the register 12 is input to the input terminal IN2 of the power source control section 13, and the input terminal IN2 is connected to the input terminal of the inverter B5, gate terminals of the Pch-transistor P3 and Nch-transistor N3. The gate terminals of the Pch-transistor P4 and the Nch-transistor N4.

The output terminal of the inverter B5 is connected to the gate terminal of the Nch-transistor N1. The source terminal of the Nch-transistor N1 is connected to the ground potential Gnd, and the drain terminal of the Nch-transistor N1 is connected to the one terminal of the resistor R1.

The other terminal of the resistor R1 is connected to the drain and gate terminals of the Pch-transistor P1 as well as to the gate terminals of the Pch-transistor P2 and P5. Therefore, the gate terminals of the Pch-transistors P1, P2, P5 are all at the same potential. Also, the source terminals of the Pch-transistors P1, P2, P5 are all connected to the power source potential Vcc.

The drain terminal of the Pch-transistor P2 is connected to the source terminal of the Pch-transistor P3, and the drain terminal of the Pch-transistor P3 is connected to the drain terminal of the Nch-transistor N3. The source terminal of the Nch-transistor N3 is connected to the ground potential Grid.

The junction point A1 formed by connecting the drain terminal of the Pch-transistor P3 and the drain terminal of the Nch-transistor N3 is connected to the drain terminal of the Nch-transistor N2, the terminal C1*a* of the condenser C1, and the input terminal of the inverter B3. The source terminal of the Nch-transistor N2 and the other terminal of the condenser C1 are connected to the ground potential Grid.

The drain terminal of the Pch-transistor P5 is connected to the source terminal of the Pch-transistor P4, and the drain terminal of the Pch-transistor P4 is connected to the drain terminal of the Nch-transistor N4. The source terminal of the Nch-transistor N4 is connected to the ground potential Gnd.

The junction point A2 formed by connecting the drain terminal of the Pch-transistor P4 and the drain terminal of the Nch-transistor N4 is connected to the drain terminal of the Nch-transistor N5, the one terminal C2*a* of the condenser C2, and the input terminal of the inverter B4. The source terminal of the Nch-transistor N5 and the other terminal of the condenser C2 are connected to the ground potential Grid.

Also, the input signal S to the circuit block 1 is also input in the input terminal IM of the power source control section 13, and the input terminal IN1 is connected to the input terminal of the inverter B1. The output terminal of the inverter B1 is connected to the gate terminal of the Nch-transistor N2. And, the output terminal of the inverter B1 is connected also to the input terminal of the inverter B2, and the output terminal of the inverter B2 is connected to the gate terminal of the Nch-transistor N5.

The output terminals of the inverters B3, B4 are connected to two respective input terminals of the AND-circuit K1, and the output terminal of the AND-circuit K1 is connected to the output terminal OUT1 of the power source control section 13, and the output of the output terminal OUT1 becomes the power-down signal Db.

Next, the operation of the power source control section 13 is explained. When a power-down command is not being issued from the central power-down managing apparatus 11, the power-down signal PD2 sent from the central power-down managing apparatus 11 to the input terminal IN2 through the power source control section 13 is set to the L-level. When the power-down signal PD2 is at the L-level, the power source control section 13 becomes operative as explained below.

The power-down signal PD2 at the L-level is inverted in the inverter B5 to H-level, and this H-level is input to the gate terminal of the Nch-transistor N1 such that the Nch-transistor N1 is turned on. When the Nch-transistor N1 is turned on, the potentials of the drain terminal of this Nch-transistor N1 and the gate terminals of the Pch-transistors P1, P2, P5 connected through the resistor R1 are lowered such that these Pch-transistors P1, P2, P5 are turned on. Then, the Pch-transistor P2 attains a state to be sable to supply current i1 from the drain terminal, and the Pch-transistor P5 attains a state to be able to supply current i2.

Further, because the L-level power-down signal PD2 is also input to the gate terminals of the Pch-transistor P3 and the Nch-transistor N3 to turn on the Pch-transistor P3 and to turn off the Nch-transistor N3. The L-level power-down signal PD2 is also input to the gate terminals of the Pch-transistor P4 and the Nch-transistor N4 to turn on the Pch-transistor P4 and to turn off the Nch-transistor N4.

Then, the current A supplied from the drain terminal of the Pch-transistor P2 charges the condenser C1 by way of the Pch-transistor P3 that has been turned on. Also, the current i2 supplied from the Pch-transistor P5 charges the condenser C2 by way of the Pch-transistor P4 that has been turned on.

However, if the Nch-transistor N2 is on, charging current to the condenser C1 escapes to ground potential Gnd through the Nch-transistor N2 so as to avoid charging the condenser C1. Also, if the Nch-transistor N5 is on, charging current to the condenser C2 escapes to ground potential Gnd through the Nch-transistor N5 so as to avoid charging of the condenser C2.

When the input signal S input to the input terminal IN1 of the power source control section 13 is at the H-level, this H-level input signal S is inverted in the inverter B1 to L-level, and the gate terminal of the Nch-transistor N2 receiving the output of the inverter B1 at the L-level also becomes L-level so as to turn the Nch-transistor N2 off.

Further, the L-level output of the inverter B1 is re-inverted in the inverter B2 to H-level, and the gate terminal of the Nch-transistor N5 receiving the output of the inverter B2, which is at the H-level, also becomes H-level so as to turn the Nch-transistor N5 on.

Conversely, when the input signal S is at the L-level, the gate terminal of the Nch-transistor N2 becomes H-level so as to turn the Nch-transistor N2 on. On other hand, because the gate terminal of the Nch-transistor N5 becomes L-level, this Nch-transistor N5 is turned off.

That is, when one of the Nch-transistor N2 or N5 is turned on, the other is turned off.

When the Nch-transistor N2 is turned on, both terminals of the condenser C1 are shorted so that the charge accumulated in the condenser C1 is discharged in short time. As described earlier, because the charging current i1 to the condenser C1 also escapes to ground potential Gnd through the Nch-transistor N2, the potential of the terminal C1*a* of the condenser C1 decreases approximately to the ground potential Gnd.

Similarly, when the Nch-transistor N5 is turned on, both terminals of the condenser C2 are shorted so that the charge accumulated in the condenser C1 is discharged in short time. As described earlier, because the charging current i2 also escapes to ground potential Gnd through the Nch-transistor N5, the potential of the terminal C2*a* of the condenser C2 decreases approximately to the ground potential Gnd.

As described above, because when one of the Nch-transistor N2 or N5 is turned on, the other is turned off, even if the potential of either the terminal C1*a* of the condenser C1 or the terminal C2*a* of the condenser C2 has dropped close to the ground potential Gnd, the other has been increased due to the charging current.

That is, if the input signal S is at the L-level, the output of the inverter B1 becomes H-level, and this H-level is input in the gate terminal of the Nch-transistor N2 so that the Nch-transistor N2 is turned on, and the charge on the condenser C1 is discharged by the Nch-transistor N2.

In this case, the output of the inverter B2 becomes L-level in contrast to the output of the inverter B1. Because this L-level is input in the gate terminal of the Nch-transistor N5, the Nch-transistor N5 is turned off and the condenser C2 is charged by the charging current i2.

Conversely, if the input signal S is H-level, the output of the inverter 131 becomes L-level. Because this L-level is input in the gate terminal of the Nch-transistor N2, the Nch-transistor N2 is turned off and the condenser C1 is charged by the charging current i1.

In this case, the output of the inverter B2 becomes H-level in contrast to the output of the inverter B1. Because this H-level is input in the gate terminal of the Nch-transistor N5, the Nch-transistor N5 is turned on and the charge on the condenser C2 is discharged by this Nch-transistor N5.

That is, the condensers C1, C2 are not charged at the same time, and depending on the voltage level of the input signal S, only one of the condensers is charged while the other is discharged.

If the input signal S is active, the voltage level of this input signal S alternates periodically between the L-level and H-level so that the condensers C1, C2 are charged or discharged alternatingly. As such, the potential of the terminal C1*a* of the condenser C1 will not exceed a certain constant potential. Also, the potential of the terminal C2*a* of the condenser C2 will not exceed a certain constant potential.

Here, when the input signal S alternatives between the L-level and the H-level periodically, each constant is preset so that the potential of the terminal C1*a* of the condenser C1 will not exceed the threshold potential of the input terminal of the inverter B3, and so that the potential of the terminal C2*a* of the condenser C2 will not exceed the threshold potential of the input terminal of the inverter B4. That is, each constant is preset so that the above-mentioned "a certain constant potential" will be at the threshold potential of the input terminal of the later-stage inverter. Here, each constant relates specifically to each of the values of the charging current il, i2 and the values of the capacitance of the condensers C1, C2 or the like, and these constants are discriminated according to the frequency of the input signal S. Also, the charging currents i1, i2 are discriminated by the values of the resistor R1 and the resistance components of the Pch-transistors P1, P2, P5.

Therefore, if the input signal S is active and this input signal S alternates between the L-level and the H-level, the input in the inverter B3 will not exceed the threshold value of this inverter B3 and the input in the inverter B4 will not exceed the threshold value of this inverter B4. Therefore, the output of the inverters B3, B4 both become H-level.

When the output of both inverters B3, B4 become H-level, the power-down signal Db, which is the output from the AND-circuit K1 that receives these H-levels, also becomes H-level.

According to the above, when the power-down signal PD2 input in the input terminal IN2 of the power source control section 13 and sent from the central power-down managing apparatus 11 is at the L-level, (i.e., when a power-down command has not been issued from the central power-down managing apparatus 11) and the input signal S, for the circuit block 1 to be input in the other input terminal IN1 of the power source control section 13, is active, (i.e., when this input signal S periodically alternates between the L-level and the H-level), the power-down signal Db output from the output terminal OUT1 of the power source control section 13 is H-level, (i.e., a voltage level to indicated that the input signal S is active).

However, when the input signal S becomes inactive and this input signal S is fixed at either the L-level or the H-level, either the condenser C1 or the condenser C2 becomes non-discharging, resulting in one condenser being in the state of being charged only while the other is in the state of being discharged.

For example, if the input signal S is fixed at the L-level, the output of the inverter B1 becomes H-level, and the Nch-transistor N2 becomes fixed in the on-state. Then, the charge on the condenser C1 is discharged by the on-state Nch-transistor N2, and the charging current i1 escapes to ground potential Gnd through the Nch-transistor N2 such that the potential of the terminal C1*a* of the condenser C1 becomes fixed approximately at the ground potential Grid.

Also, because the output of the inverter B1 is H-level, the output of the inverter B2 in the later-stage of the inverter B1 also becomes L-level, and the Nch-transistor N5 is fixed in the off-state. Then, the condenser C2 is continued to be charged by the charging current i2, and in time, the terminal C2*a* of the condenser C2 exceeds the threshold potential of the inverter B4.

Then, because the input to the inverter B3 is fixed at approximately the ground potential, i.e., at the L-level, the output of the inverter B3 is fixed at the H-level. Also, the input to the inverter B4 becomes higher than the potential of the threshold potential for the inverter B4, i.e., the H-level, so that the output of this inverter B4 becomes L-level.

Then, the output of the AND-circuit K1 receiving the output from the inverters B3 and B4, the power-down signal Db becomes L-level, (i.e., a voltage level to indicate that the input signal S is inactive), because the output of the inverter B3 is at the H-level and the output of the inverter B4 is at the L-level.

Conversely, when the input signal S is fixed at the H-level, because the Nch-transistor N2 is fixed in the off-state and the Nch-transistor N5 is fixed in the on-state, the condenser C1 is charged while the condenser C2 is discharged. Then, because the input to the inverter B3 becomes the H-level, the output of this inverter B3 becomes the L-level. Also, because the input of the inverter B4 becomes the L-level, the output of the inverter B4 becomes the H-level.

When the output of the inverter B3 becomes the L-level and the output of the inverter B4 becomes the H-level, the output of the AND-circuit K1 receiving these input, that is, the power-down signal Db becomes the L-level, (i.e., a voltage level to indicate that the input signal S is inactive).

That is, even if the input signal S is fixed at either the L-level or the H-level, the power-down signal Db output from the output terminal OUT1 of the power source control section 13 is the L-level, that is, a voltage level to indicate that the input signal S is inactive. That is, the power source control section 13 is able to detect that the input signal S is inactive, regardless of whether the voltage level is fixed at the H-level or the U-level when the input signal S is inactive.

Next, the operation of the apparatus is explained when a power-down command is issued from the central power-down managing apparatus 11 and the power-down signal PD2 input in the input terminal IN2 of the power source control section 13 becomes H-level. When the power-down signal PD2 becomes H-level, the H-level power-down signal PD2 is inverted by the inverter B5 to L-level, resulting in this L-level being input in the gate terminal of the Nch-transistor N1, and this Nch-transistor N1 is turned off.

When the Nch-transistor N1 is turned off, all the current paths from the power source potential Vcc to the ground potential Gnd within the power source control section 13 are shut-off, and no power is consumed within the power source control section 13, and the entire power source control section 13 is powered down.

That is, when the Nch-transistor N1 is turned off, Pch-transistors P1, P2, P5 connected this Nch-transistor N1 by way of the resistor R1 are also turned off. Also, because the H-level power-down signal PD2 is also input in the gate terminals of the Pch-transistor P3, Nch-transistor N3, Pch-transistor P4, and Nch-transistor N4, such that P3 and P4 are turned off and N3, N4 are turned on. Therefore, all the current paths from the power source potential Vcc to the ground potential Gnd, that is, the path containing the Pch-transistor P1, the path containing P2, the path containing P5 are all shut down, resulting that there is no power consumption within the power source control section 13, and the entire power source control section 13 is powered down.

Also, because the Nch-transistors N3 and N4 are turned on, regardless of whether the Nch-transistors N2, N5 are turned on or off, both condensers C1 and C2 are discharged and the L-level is input in both inverters B3, B4 so that both outputs.from these inverters B3, B4 become H-level. Because these H-levels are input in the AND-circuit K1, the output of the AND-circuit K1, that is, the power-down signal Db becomes H-level, i.e., a voltage level to indicate the active state.

That is, when a power-down signal is issued from the central power-down managing apparatus 11 and the power-down signal input in the input terminal IN2 of the power source control section 13 becomes H-level, the power-down signal Db output from the output terminal OUT1 of the power source control section 13 is put to the H-level first, i.e., a voltage level to indicate the active state, and then the power source control section 13 itself is powered down.

Further, it should be noted that the input signal in the present invention can be applied not only to the clock signal described above, but also to a signal format such that the minimum operational frequency is above a certain value. For example, the signal may be modulated signals such as ELAJ/CP1201 or delta-sigma modulated 1-bit streams.

What is claimed is:

1. A power control apparatus for determining whether an input signal in a circuit block to be controlled is active or inactive thereby outputting a power-down signal to power down said circuit block when the input signal is determined to be inactive, comprising:

a switch that turns on or off according to a voltage level of the input signal to the circuit block;

a condenser whose charging current or discharging current is controlled by said switch; and a comparator to compare a voltage between both ends of said condenser with a specific reference voltage, and to output the power-down signal to power down said circuit block in accordance with a result of comparison.

2. The power control apparatus according to claim 1, wherein the input signal to the circuit block alternates between a first voltage level and a second voltage level at a frequency less than a specific cycle.

3. The power control apparatus according to claim 1, wherein said power control apparatus includes a first discrimination section and a second discrimination section, and said first discrimination section includes:

a first switch that turns on or off according to a voltage level of the input signal to the circuit block, and that turns off when said input signal is at a first voltage level;

a first condenser whose charging current or discharging current is controlled by said first switch;

a first comparator to compare a voltage between both ends of said first condenser with a specific reference voltage, and to output a first power-down signal in accordance with a result of said first comparator; and said second discrimination section includes:

a second switch that turns on or off according to a voltage level of the input signal to the circuit block, and that turns off when said input signal is at a second voltage level;

a second condenser whose charging current or discharging current is controlled by said second switch;

a second comparator to compare a voltage between both ends of said second condenser with a specific reference voltage, and to output a second power-down signal in accordance with a result of said second comparator; and an outputting device to output the power-down signal to power down said circuit block when said first power-down signal or said second power-down signal is output.

4. The power control apparatus according to claim 3, wherein the input signal to the circuit block alternates between the first voltage level and the second voltage level at a frequency less than a specific cycle.

5. The power control apparatus according to claim 1, further comprising:

a synthesizer for synthesizing an external power-down signal according to an external power-down signal input externally to the power control apparatus and an internal power-down signal to be output when the input signal to said circuit block is determined as inactive, and for outputting a synthesized power-down signal to said circuit block; and a self-powering-down device for powering-down the power control apparatus when said external power-down signal is input.

6. The power control apparatus according to claim 5, wherein the input signal to the circuit block alternates between a first voltage level and a second voltage level at a frequency less than a specific cycle.

7. The power control apparatus according to claim 5, wherein, when said external power-down signal is received, said self-powering-down device prohibits outputting said internal power-down signal to said synthesizer and then powers down the power control apparatus.

8. The power control apparatus according to claim 6, wherein, when said external power-down signal is received, said self-powering-down device prohibits outputting said internal power-down signal to said synthesizer and then powers down the power control apparatus.

* * * * *